US008155549B2

(12) United States Patent
Boness et al.

(10) Patent No.: US 8,155,549 B2
(45) Date of Patent: Apr. 10, 2012

(54) DUPLEX ELECTROPHOTOGRAPHIC PRINTING USING SACRIFICIAL SHEETS

(75) Inventors: Jan D. Boness, Bad Bramstedt (DE); Robert Hoyer, Wanderup (DE); Stefan Schluenss, Schacht-Audorf (DE); Stefan Schrader, Kiel (DE); Jens Ellerbrock, Schönkirchen (DE)

(73) Assignee: Eastman Kodak Company, Rochester, NY (US)

( * ) Notice: Subject to any disclaimer, the term of this patent is extended or adjusted under 35 U.S.C. 154(b) by 408 days.

(21) Appl. No.: 12/375,761

(22) PCT Filed: Jul. 27, 2007

(86) PCT No.: PCT/EP2007/006651

§ 371 (c)(1),
(2), (4) Date: Jan. 30, 2009

(87) PCT Pub. No.: WO2008/025419

PCT Pub. Date: Mar. 6, 2008

(65) Prior Publication Data

US 2009/0324264 A1 Dec. 31, 2009

(30) Foreign Application Priority Data

Aug. 30, 2006 (DE) ..... 10 2006 040 528

(51) Int. Cl.
*G03G 15/00* (2006.01)

(52) U.S. Cl. ..... 399/72; 399/15; 399/82

(58) Field of Classification Search ..... 399/82, 399/72, 15, 49, 302

See application file for complete search history.

(56) References Cited

U.S. PATENT DOCUMENTS

| | | | | |
|---|---|---|---|---|
| 7,035,557 | B2 * | 4/2006 | Boness et al. | 399/49 |
| 2004/0234284 | A1 | 11/2004 | Boness et al. | |
| 2005/0175387 | A1 | 8/2005 | Bakken et al. | |
| 2005/0211902 | A1 * | 9/2005 | Barry et al. | 399/15 |
| 2007/0041764 | A1 | 2/2007 | Pareigis et al. | |

FOREIGN PATENT DOCUMENTS

| | | |
|---|---|---|
| DE | 10040368 | 3/2002 |
| DE | 10304763 | 8/2004 |
| EP | 1223036 | 12/2007 |

OTHER PUBLICATIONS

German Search Report, Aug. 21, 2008 (from parent application DE 10 2006 040 528.5). The translation of p. 3, the second bullet is as follows: "discharging of a sheet no more used for duplex printing after first side printing is known from this prior art specifically paragraph 0022." It refers to parts of paragraph 19 of the equivalent US 2007/041764 starting at "after fusing has taken place . . . " up to "as indicated by the arrow 12'".

* cited by examiner

*Primary Examiner* — David Gray
*Assistant Examiner* — Laura Roth
(74) *Attorney, Agent, or Firm* — Donna P. Suchy; Christopher J. White

(57) ABSTRACT

A device and a method for improving the quality of prints using a printing device and system for carrying out a print job with a digital printing machine, preferably with a printing machine that works with a toner, in particular with an electrophotographically operating printing machine, whereby the sheets (1) are preferably printed by recto-printing and verso-printing, whereby the sheets (1) to be printed are divided into batches, and whereby, in the case of batches that are incompletely occupied with sheets (1), the slots of the missing sheets are replaced by an approximately sheet-sized toner field (3) on the transport belt (4) for the sheets.

6 Claims, 3 Drawing Sheets

DUPLEX ELECTROPHOTOGRAPHIC PRINTING USING SACRIFICIAL SHEETS

FIELD OF THE INVENTION

The invention relates generally to the field of printing, and more particularly digital color reproduction systems that incorporate a printing device and system for printing sheets with accurate registration with respect to its position, including in duplex printing.

BACKGROUND OF THE INVENTION

Digital color reproduction printing systems typically include digital front-end processors, digital color printers, and post finishing systems (e.g., UV coating system, glosser system, laminator system, etc). These systems reproduce original color onto substrates (such as paper). The digital front-end processes take input electronic files (such as PDF or postscript files) composed of imaging commands and/or images from other input devices (e.g., a scanner, a digital camera) together with their own internal other function processes (e.g., raster image processor, image positioning processor, image manipulation processor, color processor, image storage processor, substrate processor, etc) to rasterize the input electronic files into proper image bitmaps for the printer to print. An operator may be assisted to set up parameters such as layout, font, color, paper, post-finishing, and etc among those digital font-end processes. The printer (e.g., an electrographic printer) takes the rasterized bitmap and renders the bitmap into a form that can control the printing process from the exposure device to writing the image onto paper. The post-finishing system finalizes the prints by adding finishing touches such as protection, glossing, and binding etc.

In an electrophotographic modular printing machine of known type, for example, the Eastman Kodak NexPress 2100 printer manufactured by Eastman Kodak, Inc., of Rochester, N.Y., color toner images are made sequentially in a plurality of color imaging modules arranged in tandem, and the toner images are successively electrostatically transferred to a receiver member adhered to a transport web moving through the modules. Commercial machines of this type typically employ intermediate transfer members in the respective modules for the transfer to the receiver member of individual color separation toner images. In other printers, each color separation toner image is directly transferred to a receiver member. Electrophotographic printers having multicolor capability are known to also provide an additional toner depositing assembly for depositing clear toner.

In U.S. patent application Ser. No. 11/062,972, filed on Feb. 22, 2005, in the names of Yee S. Ng et al., a method is disclosed of forming a print having a multicolor image supported on a receiver member wherein a multicolor toner image is formed on the receiver member by toners of at least three different colors of toner pigments which form various combinations of color at different pixel locations on the receiver member to form the multicolor toner image thereon; forming a clear toner overcoat upon the multicolor toner image, the clear toner overcoat being deposited as an inverse mask; pre-fusing the multicolor toner image and clear toner overcoat to the receiver member to at least tack the toners forming the multicolor toner image and the clear toner overcoat; and subjecting the clear toner overcoat and the multicolor toner image to heat and pressure using a belt fuser to provide an improved color gamut and gloss to the image.

Color inaccuracies, including misregistration, occur in all printing systems, including the electrophotographic printing systems. The system environment can change when components, such as the fuser roller, change their operational characteristics over time. Typically linearization processes are used to re-calibrate the printer system, in conjunction with the use of other devices, so that the digital front-end processors are more independent from printer behavior changes. However, in the whole color reproduction printing system, which includes both printer and post finishing system (e.g., UV coater, glosser, and etc), the linearization process alone cannot fully correct the whole color reproduction system variability with out effective controls and controlling systems, such as effective registration devices and color measurement systems. Without these controlling systems the resultant colors may be incorrectly shifted (for example, red shift or green shift), and the resulting reproduction may be perceived as unacceptable to the customer. It is important to make corrections and adjustments to recreate the desired perceived images. However, making these changes can be time consuming and expensive using the current control systems, as well as ineffective.

The present invention overcomes this shortcoming by making image control, that incorporates a control system and related method, more efficient and accurate and allowing it to occur automatically during the printing run. The following invention solves the current problems with image location control in a wide variety of situations, including duplex printing.

SUMMARY OF THE INVENTION

In accordance with an object of the invention, both a device and a method are provided for improving the quality of prints using a printing device that includes a system and related method for controlling registration and printing whereby, the sheets to be printed are divided into batches, and whereby, in the case of batches that are incompletely occupied with sheets, the slots of the missing sheets are replaced by an approximately sheet-sized toner field on the transport belt for the sheets characterized in that at least the toner field preceding a subsequently to be printed sheet is replaced by a sacrificial sheet that can be disposed of as waste.

DETAILED DESCRIPTION OF THE INVENTION

The present description will be directed in particular to elements forming part of, or cooperating more directly with, apparatus and methods in accordance with the present invention. It is to be understood that elements not specifically shown or described may take various forms well known to those skilled in the art. The invention relates to a method of controlling the printing of a job in a digital multi-color printing machine for printing sheets during a printing process. The sheets to be printed are divided into batches, and whereby, in the case of batches that are incompletely occupied with sheets, the slots of the missing sheets are replaced by an approximately sheet-sized toner field on the transport belt for the sheets characterized in that at least the toner field preceding a subsequently to be printed sheet is replaced by a sacrificial sheet that can be disposed of as waste. The invention relates to a method for carrying out a print job with a digital printing machine, preferably with a printing machine that works with a toner, in particular with an electrophotographically operating printing machine, whereby the sheets are preferably printed by recto-printing and verso-printing, whereby the sheets to be printed are divided into batches, and whereby, in the case of batches that are incompletely occupied with sheets, the slots of the missing sheets are replaced by an approximately sheet-sized toner field on the transport belt for the sheets. The aforementioned method relates to a method in accordance with document DE 103 04 763.

Figure 1:
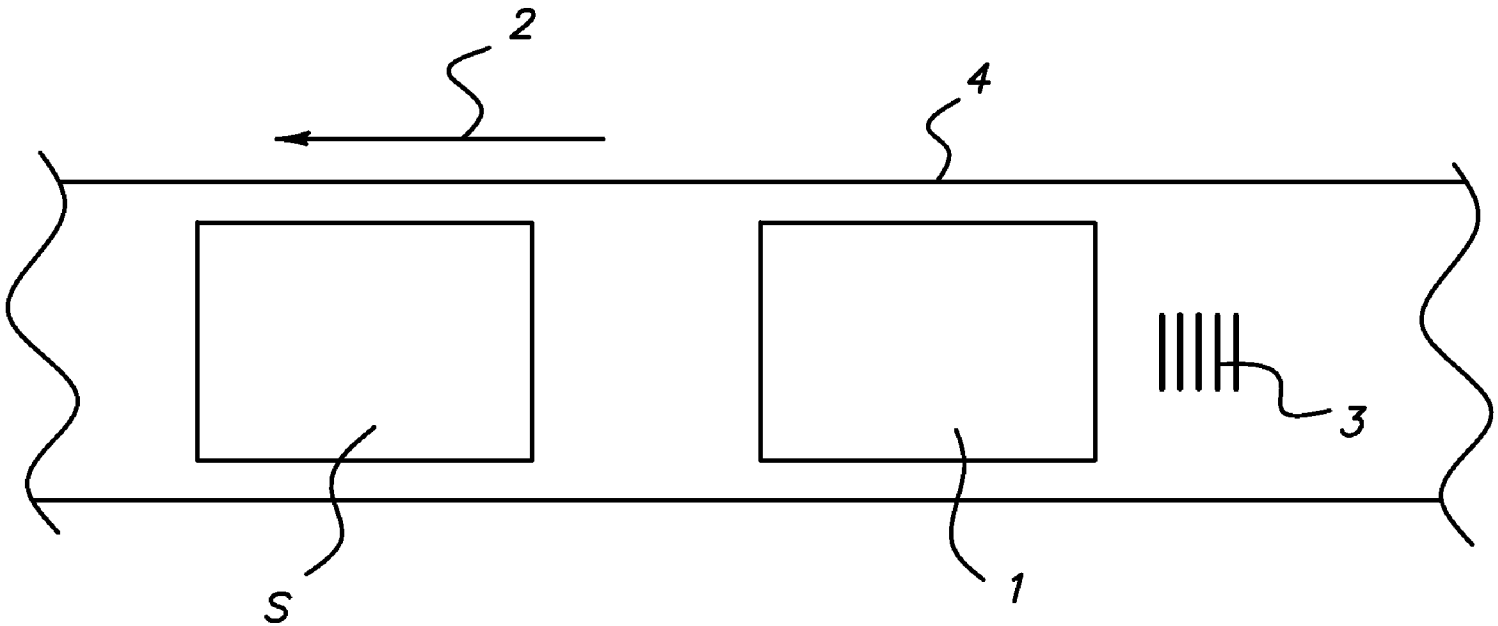
FIG. 1 is a schematic showing sheets on a transport belt in a printer.

FIG. 1 shows a plan view of sheets on a transport belt. FIG. 1 shows a plan view of sheets 1, along with sheet sized toner fields (S) that may hold a sacrificial sheet that can be disposed of as a waste sheet and may precede the to-be-printed sheet. The sheets are transported on a transport belt 4 in the direction of an arrow 2. Respectively after each sheet 1 is an array of line-shaped register marks 3 applied to the transport belt. In the present case, for example, respectively five register marks can be seen (3). For example (viewed against transport direction 2), initially a type of guide mark could be applied, relative to which the position of the other register marks can be determined. This register mark could preferably be applied in black, i.e., be produced by a printing unit using the "Key" color. Then follow, against transport direction 2, i.e., in the sequence of application, again one register mark, in the present case, e.g., "Key", "Yellow", "Magenta" and "Cyan" for each available printing unit of a multi-color printing machine. Additional printing units are used, for example with custom colors, these printing units would also have to produce additional register marks. As an aside, it should be mentioned that this is referred to as an "application" of register marks. Basically, this could also be referred to as "printing"; however, in an electrophotographic (EP) printing machine, register marks are usually applied to the transport belt only as toner, which is not fused in order to be able to better remove it again from the transport belt at a later time. However, it could be a matter of discussion whether an electrophotographic (EP) printing includes fusing or not. In this context, the concepts "printing", "applying" and "creating" in conjunction with register marks are to be understood as being synonymous, should there be any doubt. Specifically meant is the generation of a recognizable and measurable register mark.

Figure 2:
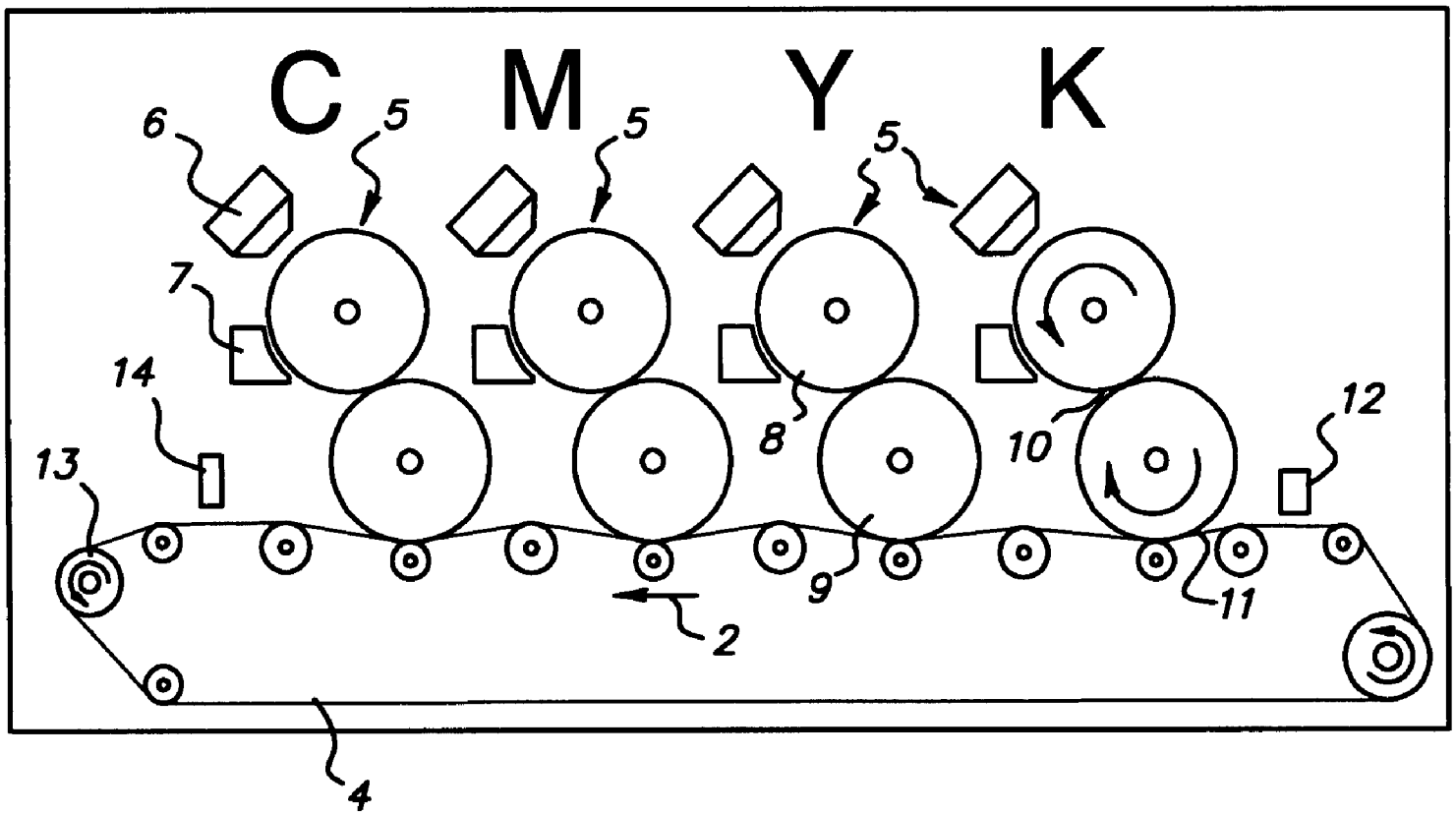
FIG. 2 shows a printer with a device and system of the present invention.

FIG. 2 shows a side elevation of a part of an EP printing machine, depicted schematically. Shown is a transport belt (web) 4 in accordance with FIG. 1, which is moved in the direction of arrow 2. Above this transport belt 4, on which sheets 1 can be transported, are four printing units or printing modules 5. These printing units 5 are labeled with the printing inks used by them, in this case abbreviated as follows: "K(Black)", "Y(ellow)", "M(agenta)" and "C(yan)". Each of these printing units 5 comprises essentially one write head 6, a toning station 6, an imaging cylinder 8, and a blanket cylinder 9. Write head 6 is used to apply the image to imaging cylinder 8, for example, by means of laser diodes, in order to create a latent printing image on imaging cylinder 8, said image being developed later with toner from toning station 7. Via a nip 10 (Nip1), this printing image is transferred to blanket cylinder 9, which transfers this printing image in a nip 11 (Nip2) to a sheet, which is transported, on the transport belt. The arrival of such a sheet is announced by a lead edge sensor 12, which, for example configured as a light barrier, recognizes the leading edge of the sheet. For transport, drive rollers 13 drive transport belt 4.

In electrophotographically operating printing machines, the sheets 1 to be printed are frequently transported on the transport belt 4 through the printing units. After the printing step, the toner, in particular a powder toner, is fused to the sheet 1. This is often achieved by contact with hot fusion rollers. In order to prevent the toner from adhering to the fusion roller, oil is applied to the fusion roller in most cases. Therefore, there is a risk of this oil being spread on the transport belt itself, especially if there are gaps between the sheets on the transport belt, i.e., if at least one sheet slot remains unoccupied, because the batch to be printed is incomplete, for example, because the number of sheets to be included in the print job is not divisible without remainder by the number of sheets in a batch, whereby the number of sheets in such a batch preferably is a function of the length of a turn-over/verso-printing path and the sheet format to be placed in said path. In this case, particularly, the last batch to be printed remains partially empty, because only the remainder of the last sheets of the print job still needs to be printed. However, if such slots remain unoccupied during the recto-printing pass, the verso-printing pass of this incomplete last sheet batch directly follows the pass of the free slots. Therefore, a clean sheet that is to be verso-printed follows a free slot again.

In order to prevent oil from being spread onto the free slots of the transport belt or to have this oil be better absorbed and bound, these unoccupied slots are covered with sheet-sized toner fields, including sheets S, which absorb toner if necessary. As it is, the transport belt 4 must be cleaned regularly to remove toner residue, because, for example, registration marks are also applied to the transport belt, said registration marks having to be completely removed thereafter. This is because oil on the transport belt 4 could contaminate the cylinders, in particular an imaging cylinder and/or a (rubber) blanket cylinder, in a printing unit and thus considerably impair subsequent prints.

Since these sheet-sized toner field exhibit different behavior that effects registration and/or alignment control it is necessary to adjust the registration and/or alignment control in order to avoid errors since these systems and controls are set up to work with a same-size sheet that may have different properties, such as, among other things, those that could be caused by the different slip behavior of the affected printing unit cylinders on these different surfaces.

Therefore, it is necessary to determine the behavior of the toner fields and associated sheets (S) that might be used in a print job in connection with registration and/or alignment control and error avoidance. This information is obtained by moving such toner fields through calibration cycles of the printing machine. Document DE 103 04 763 A1 refers to such calibration cycles as follows.

Preferably instead of one of said individual register marks, a plurality of register marks is used to determine the average of their measured results or of the measured results of their respective same-color marks. As a result of the plurality of register marks, more information allowing the reliable detection and elimination of registration errors can be attained in one measuring cycle, i.e., in particular, considering registration errors that are caused or are to be eliminated in different ways, preferably also including the magnification-type registration error that cannot be detected based on individual register marks. On the other hand, the process is made relatively fast due to this averaging of data. It is suitable for online application.

Furthermore, it may be provided that a plurality of toner fields at a distance from each other is successively applied to the transport belt in transport direction, and that, in each intermediate space between two successive toner fields, at least one register mark is applied to the transport belt, whereby preferably the average of the measured results for the register marks located in the intermediate spaces between the toner fields or for their respective same-color marks is determined.

A so-called gear-type registration error be corrected, said error being caused in that a toner field is forced through the narrow gap (nip) between the transport belt and a consequently indirectly driven following printing member or transfer member applying the printing image to the printing material, or forced between a transfer member and an imaging member whose speed is changed as a result of this, and/or that a so-called magnification-type registration error is corrected, said error being caused in that a toner field is forced through the narrow gap (nip) between the transport belt and a printing member or transfer member applying the printing image to the printing material, or forced between an imaging member and a transfer member whose shape is changed in the printing region as a result of this. A modification of the registration method provides that, from the available plurality of toner fields and/or register marks applied in the intermediate spaces between the toner fields, only one selected, predetermined number be used. Preferably, in addition, a plurality of register marks are applied to the transport belt upstream of the entirety of toner fields and/or downstream of the entirety of toner fields, in which case, in particular, the register marks downstream of the toner fields may also be omitted. For the precise number of the plurality of register marks and toner fields, an optimum is to be found between the reliability of the detection of errors and the time used for the necessary measurements. The plurality of register marks upstream of and/or downstream of the toner fields, in each instance, should be on the order of 20 to 60 register marks, in which case, preferably, the same number of register marks is used upstream of and downstream of the toner fields as further described in the German DE 103 04 763 A1 which is incorporated by reference.

One embodiment of this invention is especially useful in duplex printing. Depending on the sheet format that is used, registration and/or alignment control which has been modified for a toner field will still affect the subsequent one to two sheets that follow the last toner field, i.e., in the above-described example, the first one or two sheets of the last verso-printing pass. This is because the registration and/or alignment control requires a specific period of time to adjust to the new conditions with the sheets that are now present again. During this transition, an intolerable registration and/or alignment error on the order of a few hundred μm can occur. This error can render the first one to two sheets following the last toner field unusable.

This embodiment solves this problem by using at least one toner field, preceding the subsequent to-be-printed sheet 1 is replaced by the sacrificial sheet S that can be disposed of as waste.

In a preferred embodiment the at least one sacrificial sheet is advantageously provided which may be unusable and which may be disposed of, so that the subsequent sheet that is again to be provided with a clean print no longer displays the troublesome registration and/or alignment error. When this method is used, it must be taken into consideration that, depending on the printing material that is used, such a sacrificial sheet is significantly more expensive than a toner field. Therefore, only a minimal number of one to two sacrificial sheets should be used, provided they are in fact necessary. However, in accordance with the invention, the situation could arise that only one toner field had been planned for anyway, which would now be replaced by a sacrificial sheet, so that no toner field would remain at all.

It is more economical if such a sacrificial sheet is used only for a recto-printing pass of the sheets because, under normal circumstances, the print job would end at the end of the last verso-printing pass of the incomplete batch of sheets, and no sheet would follow the last toner fields that would be at risk. In most cases, the print job is anyhow still followed by additional toner fields for purposes of cleaning the printing machine.

A modification of the invention provides that the sacrificial sheet be directly transported out of a printing material path by ejection after the recto-printing pass. However, said sacrificial sheet could also remain for the verso-printing pass. An embodiment of a process sequence on a transport belt carrying out the inventive method is shown in FIG. 3.

Figure 3:
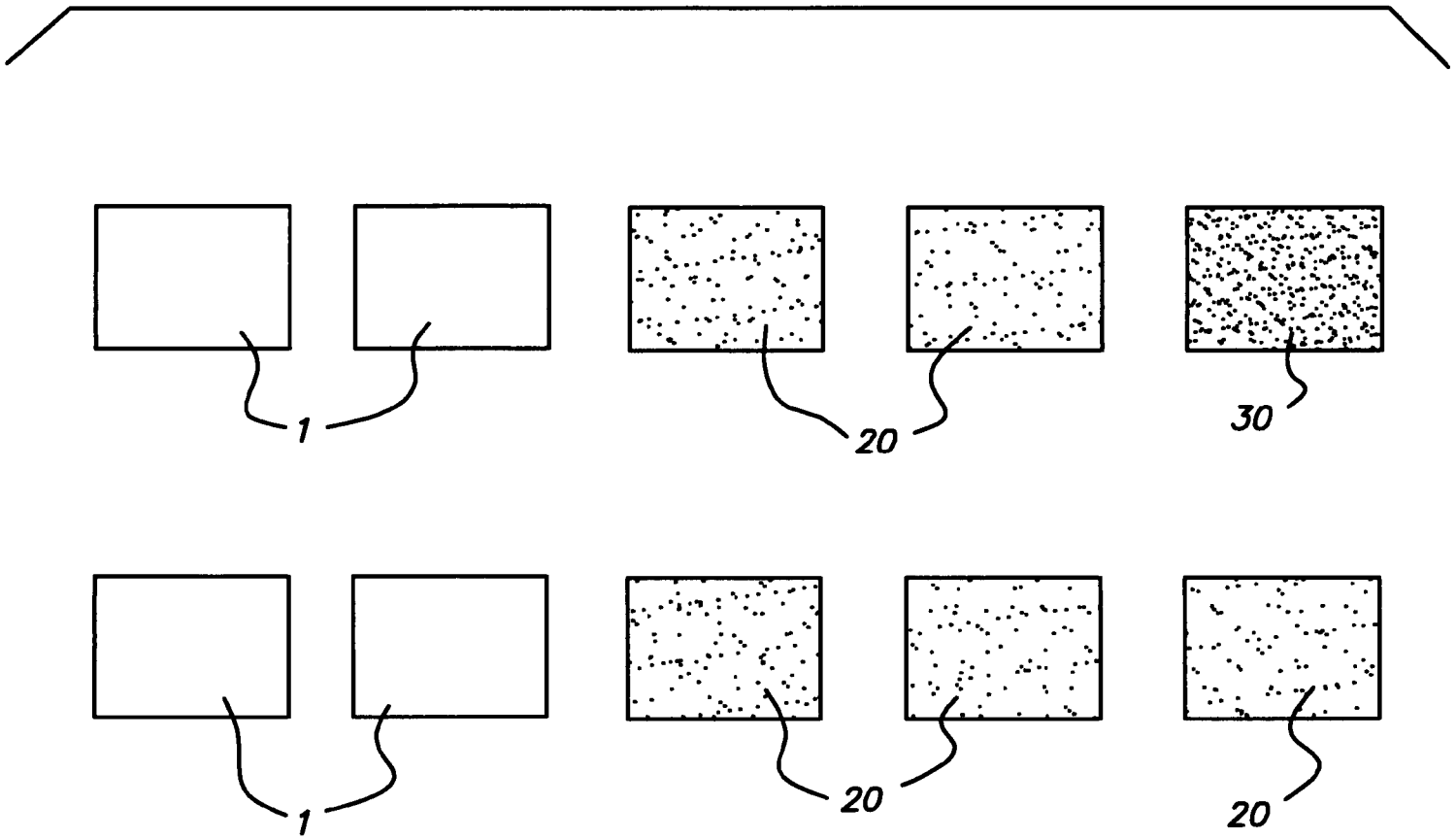
FIG. 3 shows one embodiment of the device and system of the present invention.

The top part of FIG. 3 shows a plan view of an incomplete batch of sheets during the recto-printing pass through a printing machine. The sheets are placed on a transport belt that is not specifically shown. In this case, a complete batch would comprise a number of only five sheets. Normally, however, this number is greater, for example, eighteen. The small number was only chosen for reasons of clarity.

The two last sheets 1 of a print job that are to be printed cleanly are followed by the toner fields 20 applied to the transport belt instead of the sheets 1. The last toner field 20, or the last missing sheet 1, has been replaced by an inventive sacrificial sheet 30 that has been placed on the transport belt 4.

The bottom part of FIG. 3 shows the verso-printing pass of the sheets 1. Now, the two sheets 1 are followed by three toner fields 20, because, thereafter, no further sheet to be printed cleanly follows and therefore, in this case, a sacrificial sheet 30 is no longer required. As opposed to this, the first sheet 1 in the verso-printing pass directly follows the sacrificial sheet 30 in the recto-printing pass. However, the sacrificial sheet 30 can then already be disposed of after the recto-printing pass. The reason being that said sacrificial sheet is mainly used to prepare the registration and/or alignment control for the first sheet 1 coming in the verso-printing pass. After this has happened, the sacrificial sheet 30 can be disposed of by ejection out of a transport path of the sheets. The sacrificial sheet 30 could indeed remain for the verso-printing pass in the printing machine but is not necessary there and would potentially delay the detection of the end of the print job by the printing machine and would thus lead to a small production loss.

The invention claimed is:

1. A method for carrying out a print job with a digital electrophotographic printing machine, the job having a plurality of sheets to be printed, at least one of the sheets to be printed by recto-printing and verso-printing, the printing machine including a transport belt for transporting sheets, the method comprising:

dividing the sheets into batches, at least one of which is an incomplete batch having one or more missing-sheet slots;

printing the sheets of the incomplete batch by recto-printing;

after the recto-printing step, covering one or more missing-sheet slot(s) of the incomplete batch with approximately sheet-sized toner field(s) on the transport belt;

after the covering step, transporting a sacrificial sheet in a last missing-sheet slot preceding a subsequently to be printed sheet, wherein the sacrificial sheet is used only for a recto-printing pass of the sheets;

directly transporting the sacrificial sheet out of a printing material path by ejection after the recto-printing pass; and after the ejection, printing at least one of the sheets of the incomplete batch by verso-printing.

2. The method of claim 1, wherein a controller controls the steps of the method.

3. The method of claim 1, wherein the sacrificial sheet is disposed of as waste.

4. The method of claim 1, wherein the sacrificial sheet is only used for recto printing.

5. The method of claim 1, wherein the sacrificial sheet is used for registration.

6. The method according to claim 1, wherein no toner is printed on the sacrificial sheet(s).

* * * * *